United States Patent [19]

Peltola

[11] 4,298,042

[45] Nov. 3, 1981

[54] ROTARY DELIMBER FOR TIMBER HARVESTER

[76] Inventor: Waino Peltola, Rte. 1, Tripoli, Wis. 54564

[21] Appl. No.: 72,880

[22] Filed: Sep. 6, 1979

[51] Int. Cl.[3] ..... B27L 1/00

[52] U.S. Cl. ..... 144/2 Z; 144/208 E

[58] Field of Search ..... 144/2 Z, 3 D, 208 R, 144/208 E, 311, 309 RC

[56] References Cited

U.S. PATENT DOCUMENTS

| | | | |
|---|---|---|---|
| 3,137,329 | 6/1964 | Smith | 144/208 E |
| 3,543,819 | 12/1970 | Peltola | 144/2 Z |
| 3,882,910 | 5/1975 | Peltola | 144/2 Z |

FOREIGN PATENT DOCUMENTS

| | | | |
|---|---|---|---|
| 2320450 | 10/1974 | Fed. Rep. of Germany | 144/208 E |
| 2823087 | 11/1979 | Fed. Rep. of Germany | 144/208 E |
| 2823046 | 12/1979 | Fed. Rep. of Germany | 144/208 E |
| 575219 | 6/1975 | U.S.S.R. | 144/208 E |
| 574327 | 10/1977 | U.S.S.R. | 144/208 E |

*Primary Examiner*—W. D. Bray

[57] ABSTRACT

Disclosed herein is a rotary delimber for a timber harvester in which the branches are severed from a tree trunk as the tree trunk is fed axially through a hollow rotor carrying a plurality of cutters. Each cutter is secured to a spindle rotatably supported in a cutter arm for movement about an axis transverse to the axis of the rotor. A torsion bar in each cutter arm is connected to the spindle to yieldably bias the cutter inwardly toward the axis of the rotor. The cutter arms are rotatably supported on circumferentially arranged spindles secured to an outturned flange on the rotor for movement toward and away from the axis of the rotor. Torsion springs yieldably bias the cutter arms inwardly toward the axis of the rotor. Each cutter arm is provided with a cam plate which is engageable with a roller on a clutch arm mounted on an axially movable clutch ring. The clutch ring is splined to the rotor and movable axially of the rotor by one or more hydraulic cylinders to cause engagement of the rollers with the cam plates to move the cutters and cutter arms away from the axis of the rotor to receive tree trunks of varying diameters.

The rotor is yieldably mounted on a vehicle frame to afford displacement of the rotor about horizontal and vertical axes.

6 Claims, 3 Drawing Figures

26
28
29
92
88
98
94
3
86
90
10
104
78
96
100
102
14
11
34
38
32
34
35
34A
16
84
36
119
18
58
56
52
40
34
34
30
54
53
48
54
37
20
42
24
146
44
139
118
51
24A
142
52A
22
143
50
138
46
86
25
144
128
124
3
140
126
136
160
123
120
122

ROTARY DELIMBER FOR TIMBER HARVESTER

BACKGROUND OF INVENTION

The invention relates to timber harvesters, and more particularly to a rotary delimber which can be used with the timber harvesting apparatus disclosed in my U.S. Pat. No. 3,543,819.

SUMMARY OF THE INVENTION

The invention provides a rotary delimber assembly with an axial throat and a plurality of cutters adapted to receive and delimb felled timber. The cutters are mounted on a rotor to yieldably afford displacement of the cutters about first and second transverse axes to minimize the shock loads on the cutters as they engage the limbs.

More specifically, the cutters are secured to spindles which are rotatably supported in cutter arms for movement about a first axis transverse to the axis of the rotor. The spindles are splined to the free end of torsion bars which bias the cutters inwardly toward the axis of the rotor and yieldably afford displacement of the cutters outwardly from the axis of the rotor or the longitudinal center line of the linear feed path.

The cutter arms are rotatably supported on spindles which are secured to the rotor and which are parallel with the axis of the rotor. The cutter arms are biased inwardly toward the axis of the rotor by torsion springs arranged around the spindles. The torsion springs yieldably afford displacement of the cutters about a second axis transverse to the first axis.

The invention also provides means to selectively displace the cutter arms about the cutter arm spindles to receive timber of varying diameters and position the cutters adjacent the periphery of the trunk to sever the limbs close to the trunk. The means includes cam plates on each cutter arm and clutch arms on a clutch ring which is splined to the rotor and movable axially of the rotor. The clutch arms project forwardly of the clutch ring and are provided with rollers which engage the cam plates and displace the cutter arms about the cutter arm spindles upon axial movement of the clutch ring caused by energizing one or more hydraulic cylinders having piston rods engageable with the clutch ring.

To minimize shock loads to the rotor assembly, and facilitate movement of crooked, forked, or trunks with sweeps, through the rotor assembly, this invention provides means for supporting said rotor to yieldably afford displacement of the rotor about first and second transverse axes or horizontal and vertical axes.

The rotor is rotatably supported in a support member which is provided with laterally outwardly extending horizontal trunnions which are received in coaxial apertures in upstanding legs of a yoke. The yoke is pivotally connected to a timber harvester frame or other vehicle by a vertical pin or kingpin to afford movement of the yoke and motor about a vertical axis. The means for yieldably affording displacement of the rotor about the vertical axis includes a pair of compression springs located between the rear of the yoke and upstanding brackets on the vehicle frame.

The means for yieldably affording displacement of the rotor about the horizontal axis comprises an extendible link pivotally connected at one end to the rotor supporting member and connected at the other end by a spline to a quill which is connected to a torsion bar which is mounted in the yoke and which provides torque about an axis parallel to the axis of the trunnions.

It is an object of the invention to provide a light weight and compact rotary delimber assembly which includes a plurality of cutters which are yieldably supported to afford displacement about first and second transverse axes and in which the rotor assembly is supported on a frame to yieldably afford displacement of the rotor assembly about first and second transverse axes.

It is a further object of the invention to provide a rotary delimber assembly which carries a plurality of cutters which are pivotally supported in cutter arms and in which the cutters are biased inwardly toward the axis of the rotor by torsion bars located in each cutter arm, which torsion bars also yieldably afford displacement of the cutters outwardly from the axis of the rotor.

It is an additional object of the invention to provide a rotary delimber assembly adapted to be mounted on the frame of a timber harvesting vehicle and in which the rotor assembly is mounted within the upstanding legs of a yoke by trunnions to afford displacement of the rotor about a horizontal axis and in which the yoke is pivotally connected to the vehicle frame by a kingpin to afford displacement about a vertical axis.

It is a further object of the invention to provide a rotary delimber assembly provided with cutters which are capable of moving close to an irregular surface of a tree trunk and which is adapted to remove limbs from crooked trunks and trunks with sweep.

Further objects and advantages of the invention will become apparent from the following disclosure.

THE DRAWINGS

DETAILED DESCRIPTION

Although the disclosure hereof is detailed and exact to enable those skilled in the art to practice the invention, the physical embodiments herein disclosed merely exemplify the invention which may be embodied in other specific structures. The scope of the invention is defined in the claims appended hereto.

Figure 1:
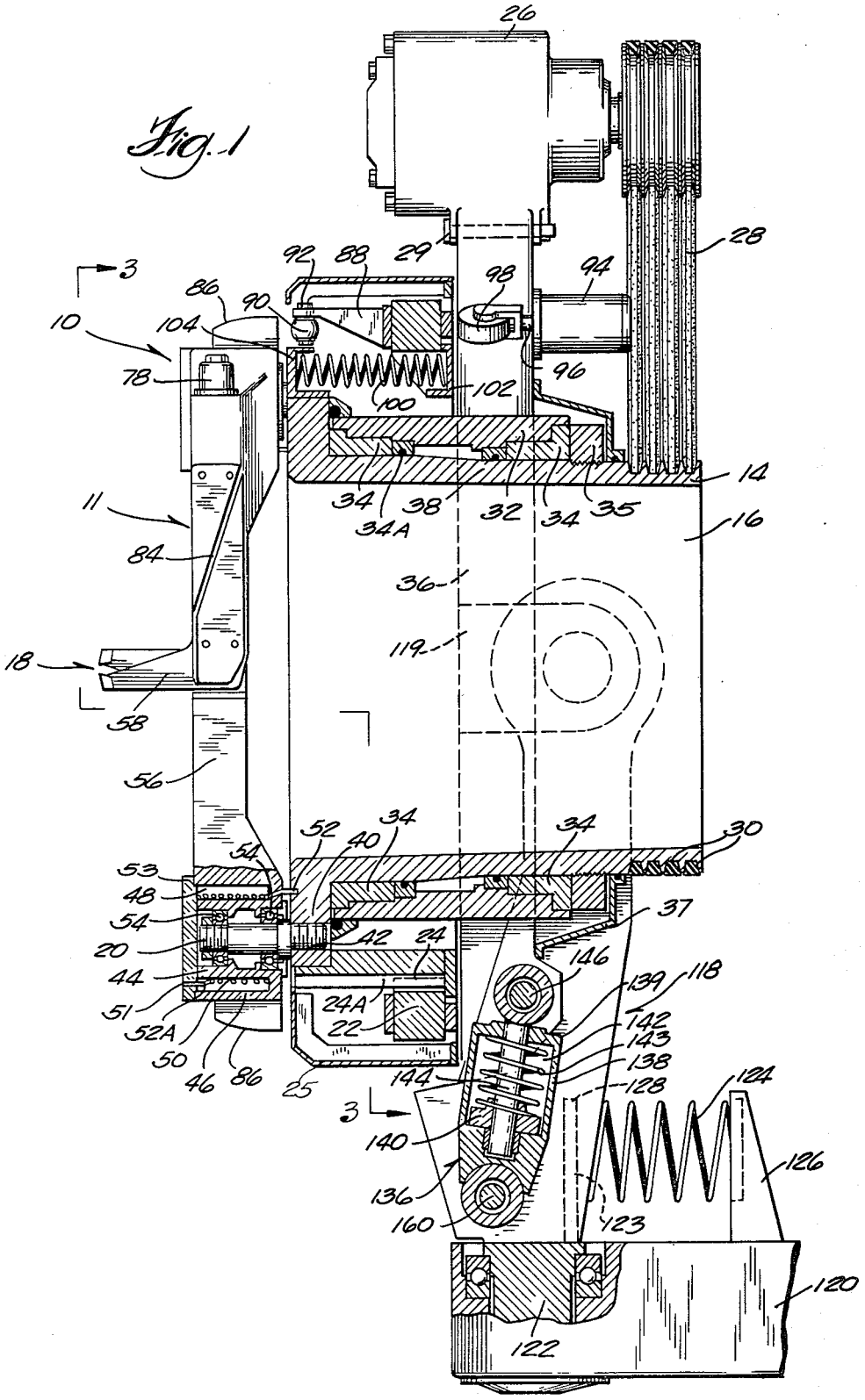
FIG. 1 is a side elevational view in fragmentary section with portions removed of a rotary delimber in accordance with the invention.
Figure 3:
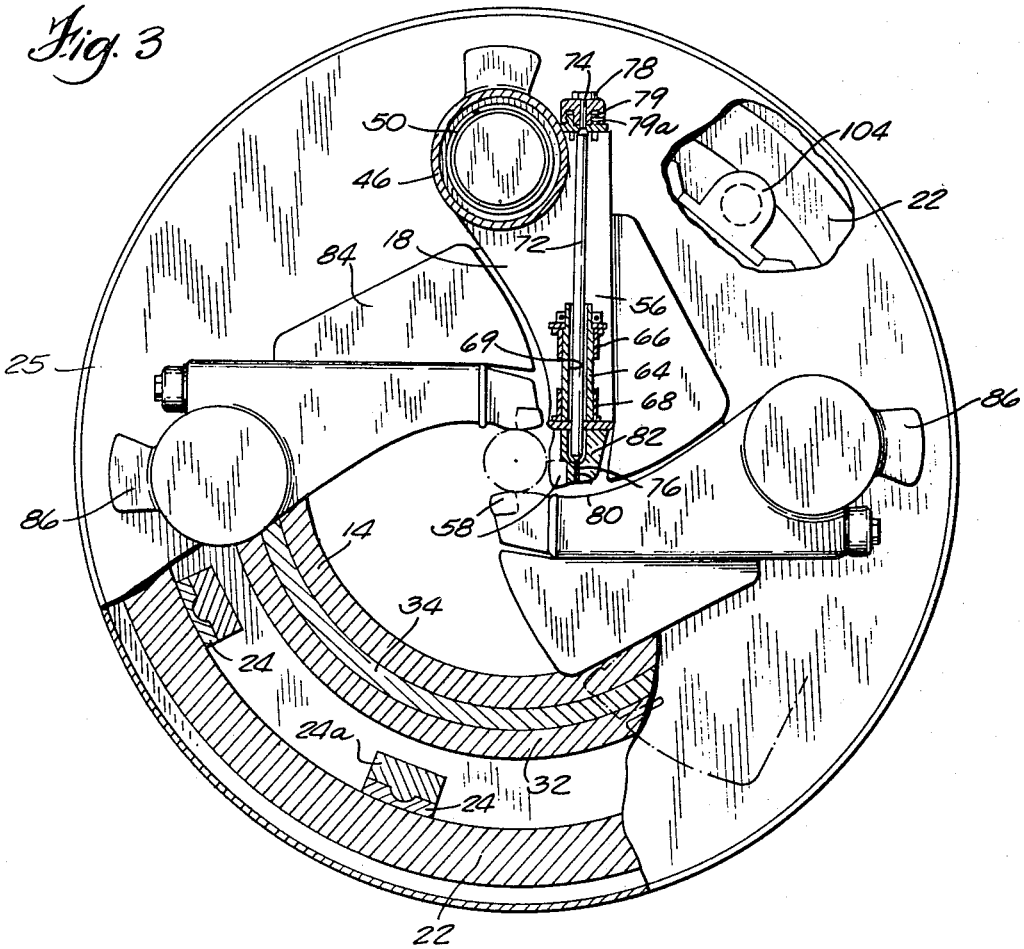
FIG. 3 is a front view with portions removed and in fragmentary section of the rotor assembly shown in FIG. 1 and taken along line 3—3 of FIG. 1.

In the drawings, FIG. 1 shows a rotary delimber which is generally designated 10 and which includes a rotor assembly 11. The rotor assembly 11 includes a rotor 14 which has an axial throat 16 which defines a linear feed path for receiving the felled timber. The rotor assembly 11 also includes a plurality of cutter arms 18 which are pivotally supported on the rotor 14 by circumferentially aligned spindles 20. The rotor assembly 11 also includes a clutch ring 22 which is splined to the rotor 14 by a series of spaced spline blocks 24 on the clutch ring 22 which interfit with the splines **24*a* on the rotor 14 (FIGS. 1 and 3). The clutch ring 22 and splines 24 and 24*a* are enclosed by an annular cowling 25. The rotor assembly 11 is driven by a motor and gear reduction unit 26 which is connected to the rotor 14 by a series of belts 28 received in annular grooves 30 in the rotor 14. The motor and gear reduction unit 26 is pivotally supported to a rotor support member 36 by a pin 29. The tension of the belts 28 is adjusted by an extendible strut 31**.

The rotor 14 is rotatably supported in a carrier hub 32 by bearings 34. The rotor assembly 11 can also include grease seals 34A. The rotor is secured in the hub 32 by a lock ring 35. A shield 37 prevents entry of debris between the hub 32 and rotor 14. The carrier hub 32 is mounted in the rotor support member 36 (FIG. 2) which is hereinafter described in detail. The rotor 14 includes a generally cylindrical wall 38 with an outturned flange or wall portion 40 at its forward end. The wall portion 40 is provided with threaded apertures 42 for threadably receiving the spindles 20 which pivotally support the cutter arms 18. The cutter arms 18 are each provided with inner and outer concentric wall portions 44 and 46 which define an annular groove or channel 48 which receives a torsion spring 50 which, in the disclosed construction, is the means for yieldably biasing the cutter arms 18 inwardly toward the axis of the rotor 14 and which yieldably affords displacement of the cutters 58 about a first axis. An end 52 of each torsion spring 50 is anchored in the flange 40 of the rotor 14. The other end 52A of the spring 50 is anchored in an aperture 51 in a cover plate 53 which is secured to the cutter arm portion 56. The cutter arms 18 are rotatably supported on the spindles 20 by a pair of bearings 54 carried by the spindles 20 and located between the spindles and the wall portions 44.

Each cutter arm 18 includes an inwardly extending arm portion 56 which extends from the wall portion 46. Cutters 58 are fixedly connected to each cutter arm 18. In accordance with the invention, means are provided for mounting the cutters 58 on the cutter arms 18 to yieldably afford displacement of the cutters about a second axis transverse to the first axis and the axis of the rotor 14. In the disclosed construction, the means includes in each cutter arm 18 a spindle 64 (FIG. 3) which is connected to the cutter arm 18 and which is rotatably supported in the cutter arm portion 56 by bearings 66 and 68 located inside the cutter arm portion 56 and fixedly secured to the cutter arm portions 56. Each spindle 64 has an axial aperture 69 which receives a torsion bar 72. The ends of the torsion bars are provided with flats or splines 74 and 76. The spline 74 extends into a torque adjustment nut 78 which is threadably received in a threaded aperture 79 in the wall 56 of the cutter arm 18. The nut 78 can be secured at the desired adjustment by a pin **79*a* which is selectively inserted through any of a series of apertures (not shown) in the nut 78 and into an aperture (not shown) in the cutter arm 18. The spline 76 interfits with splined aperture 80 in a cutter holder 82 which is a part of spindle 64**.

As shown in FIGS. 1 and 3, each cutter arm 18 is provided with an inclined brush shield 84 which prevents limbs and debris from entering the throat 16 of the rotor 14.

In accordance with the invention, means are provided for selectively displacing the cutter arms 18 outwardly from the axis of the rotor 14 to accommodate varying diameter timber and to position the cutters 58 adjacent the periphery of the trunk for severing the limbs. In the disclosed construction, the means includes an inclined cam plate 86 connected to wall portion 46 and a plurality of spaced clutch arms 88, one for each cutter arm. The clutch arms 88 are secured to the clutch ring 22 and extend axially forwardly of the clutch ring 22. Each clutch arm 88 is provided with a roller 90 rotatably mounted on the clutch arm by a pin or bolt 92 for rotation about an axis radial with respect to the axis of the rotor 14. The means also includes one or more hydraulic cylinders 94 with piston rods 96 having rollers 98. The piston rods reciprocate about an axis parallel to the axis of the rotor 14. When the hydraulic cylinders 94 are energized by actuation of suitable controls (not shown) the clutch ring 22 moves forwardly and axially with respect to the rotor so that the rollers 90 engage the cam plates 86 to thus displace the cutter arms about the spindles 20 to the selected angle of displacement or distance from the axis of the rotor 14.

The clutch ring 22 is biased to a retracted position with the clutch arms 88 out of engagement with the cam plates 86 by a plurality of springs 100 located between spring brackets 102 on the clutch ring 22 (FIG. 1) and bracket portions 104 located on the flange 40 of the rotor 14 (FIGS. 1 and 3).

To minimize loading forces on the rotor assembly and the rotor supporting member hereinafter described, the invention provides means for rotatably supporting the rotor assembly 11 to yieldably afford displacement of the rotor assembly 11 about horizontal and vertical axes. As disclosed, the means includes the rotor supporting member 36 which is provided with a pair of laterally outwardly extending horizontal trunnions 110 which are received in bearings 111 in a pair of coaxial spaced apertures 112 in upstanding legs 114 and 116 of a yoke 118. The trunnions 110 are carried by brackets 119 which are fixedly secured to the support member 36 by a weld or bolts. The trunnions 110 are fixedly secured to the brackets 119 by nuts 119A. Assembly of trunnions 110 in the yoke 118 is facilitated by end caps 120A which are bolted to the yoke 118 by bolts 121. The yoke 118 is rotatably supported on a vehicle frame 120 by a kingpin assembly or vertical pin 122 connected to the web or the bottom or lower frame portion 123 of the yoke 118.

Means are provided for yieldably affording displacement of the yoke 118 about the vertical axis provided by vertical pin 122. As disclosed, the means is in the form of two compression springs 124 (FIGS. 1 and 2) located between upstanding brackets 126 on frame 120 and the rear 128 of web 123 of the yoke 118.

Figure 2:
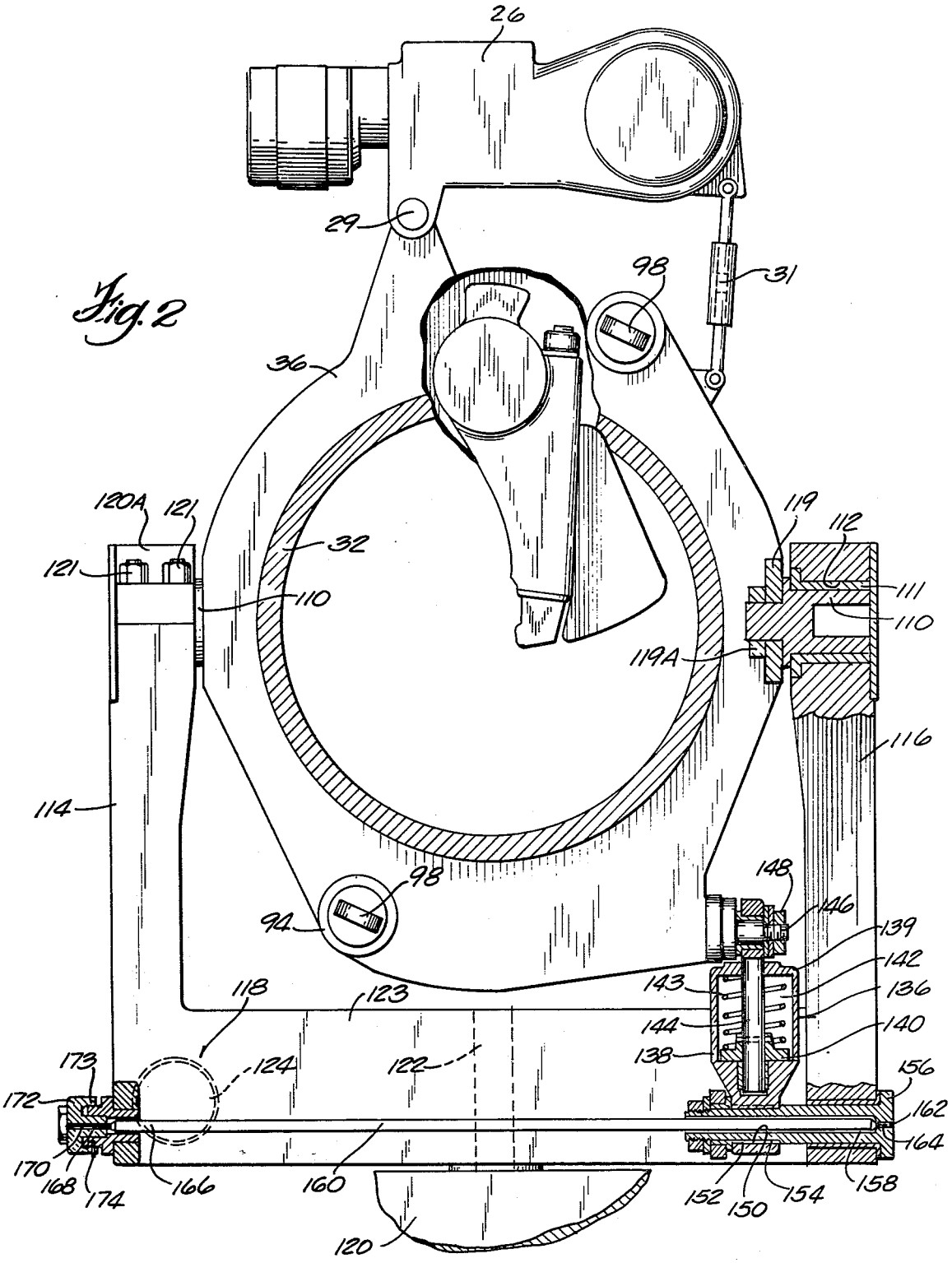
FIG. 2 is a fragmentary front end view with portions broken away of the rotary delimber shown in FIG. 1.

The means provided for yieldably affording displacement of the rotor assembly 11 about the horizontal axis provided by the trunnions 110 includes an extendible link 136 (FIGS. 1 and 2). The extendible link 136 includes a cylindrical housing 138 and a piston 140 reciprocally disposed within the interior 142 of the housing 138. The piston 140 includes a piston rod 144 which is pivotally connected to a stud 146 extending from the support member 36. A nut 148 secures the piston rod 144 to the stud 146. The extendible link 136 also includes a compression spring 143 in the interior 142 which yieldably biases the piston 142 toward a top wall or cover 139 for the housing 138. The cover 139 can be secured to the housing 138 by bolts (not shown).

The spring 143 has a sufficient carrying capacity to support the rotor assembly 11 and the rotor support member 36. The housing 138 has an aperture 150 with an internal spline 152 which interfits with an external spline 154 on a sleeve or quill 156. The quill 156 has an axial aperture 158 which receives a torsion bar 160. The torsion bar 160 has an axially extending tab or spline 162 which interfits in a slot 164 in the quill to provide a driving connection between the torsion bar 160 and the quill. The other end 166 of the torsion bar has a flat axial projection or spline 168 received in a slot or internal spline 170 in a torque adjusting nut 172 which is threadably received on a threaded boss 173. The nut 172 is secured at the desired adjustment by a pin 174 which is selectively inserted in any of a series of apertures (not shown) in the nut 172 and into an aperture in boss 173.

Various of the features of the invention are set forth in the following claims.

I claim:

1. Apparatus for delimbing trees comprising a rotor having an axial throat adapted to receive the trunk of a tree, a cutter, and means for supporting said cutter on said rotor to yieldably afford displacement of said cutter about first and second axes, and wherein said means for supporting said cutter on said rotor to yieldably afford displacement about a first axis includes a cutter arm, means for rotatably connecting said cutter arm to said rotor, and a torsion spring for yieldably biasing said cutter arm inwardly toward the axis of said rotor, and wherein said means for supporting said cutter on said rotor to yieldably afford displacement about a second axis comprises a spindle connected to said cutter, and means for rotatably supporting said spindle on said cutter arm, a torsion bar on said cutter arm, one end of said torsion bar being connected to said cutter arm and the other end being connected to said spindle.

2. Apparatus for delimbing trees comprising a rotor having an axial throat adapted to receive the trunk of a tree, a cutter, and means for supporting said cutter on said rotor to yieldably afford displacement of said cutter about first and second axes, and wherein said means for supporting said cutter on said rotor to yieldably afford displacement about a first axis includes a cutter arm, means for rotatably connecting said cutter arm to said rotor, and a torsion spring for yieldably biasing said cutter arm inwardly toward the axis of said rotor, including means for selectively displacing said cutter arm outwardly from the axis of said rotor about said second cutter axis.

3. Apparatus in accordance with claim 2 wherein said means for selectively displacing said cutter arm outwardly from the axis of said rotor about said second cutter axis comprises a clutch ring splined to said rotor for axial movement relative to said rotor, a clutch arm on said clutch ring, a cam plate on said cutter arm cooperting with said clutch arm to afford displacement of said cutter arm upon axial movement of said clutch ring, and means for moving said clutch ring axially of said rotor.

4. Apparatus for delimbing trees comprising a rotor having an axial throat adapted to receive the trunk of a tree, a cutter, and means for supporting said cutter on said rotor to yieldably afford displacement of said cutter about first and second axes, and wherein said means for supporting said cutter on said rotor to yieldably afford displacement about a first axis includes a cutter arm, means for rotatably connecting said cutter arm to said rotor, and a torsion spring for yieldably biasing said cutter arm inwardly toward the axis of said rotor, including a brush plate on said cutter arm.

5. Apparatus for delimbing trees comprising a rotor having an axial throat adapted to receive the trunk of a tree, a cutter, and means for supporting said cutter on said rotor to yieldably afford displacement of said cutter about first and second axes, and wherein said means for rotatably supporting said rotor to yieldably afford displacement of said rotor about first and second axes comprises a rotor supporting member including a pair of horizontally extending trunnions, a yoke having a pair of upstanding legs interconnected by a web, coaxial apertures in said legs for rotatably receiving said trunnions, a frame, means for rotatably supporting said yoke on said frame for movement about a vertical axis, upstanding brackets on said frame, springs located between said brackets and said yoke to yieldably afford movement of said yoke about said vertical axis, an extendible link, one end of said link being pivotally connected to said rotor supporting member, a torsion bar mounted in said yoke for rotation about an axis parallel to the axis of said trunnions, and means for connecting said torsion bar to the other end of said link to yieldably afford movement of said rotor supporting member about said horizontal axis.

6. Apparatus in accordance with claim 5, wherein said extendible link includes a housing having a cover, a piston reciprocally disposed within the interior of said housing, said piston including a piston rod pivotally connected to said rotor supporting member, said housing being connected to said torsion bar and a spring located between said piston and said cover.

* * * * *